US006378867B1

(12) United States Patent
Shalless

(10) Patent No.: US 6,378,867 B1
(45) Date of Patent: Apr. 30, 2002

(54) APPARATUS FOR PLAYING A WORD GAME

(75) Inventor: Gregory Alan Shalless, Ashburton (AU)

(73) Assignee: Crossout Pty, Ltd., Caulfield (AU)

( * ) Notice: Subject to any disclaimer, the term of this patent is extended or adjusted under 35 U.S.C. 154(b) by 0 days.

(21) Appl. No.: 09/450,358

(22) Filed: Nov. 29, 1999

Related U.S. Application Data

(63) Continuation of application No. PCT/AU98/00398, filed on May 29, 1998.

(30) Foreign Application Priority Data

May 29, 1997 (AU) ..... PO 7042
Feb. 24, 1998 (AU) ..... PP 1978

(51) Int. Cl.[7] ..... A63F 3/00

(52) U.S. Cl. ..... 273/240; 273/271; 273/272; 273/273; 273/153 R; 273/236

(58) Field of Search ..... 273/271, 273, 273/272, 283, 284, 153 R, 130 R, 135, 135 R, 236; 463/9, 14

(56) References Cited

U.S. PATENT DOCUMENTS 3,863,931 A 2/1975 Forsyth et al.
4,106,773 A * 8/1978 Coefield ..... 273/240
4,179,126 A * 12/1979 Coefield ..... 273/240
4,299,578 A * 11/1981 Wayman ..... 434/177
4,369,973 A * 1/1983 D'Aurora et al. ..... 273/153 R
4,850,595 A * 7/1989 Sherman et al. ..... 273/240
4,907,807 A * 3/1990 Lee et al. ..... 273/240
D340,262 S 10/1993 Van Akin
5,249,965 A 10/1993 Yianilos
5,566,942 A * 10/1996 Elum ..... 273/153 R
5,871,210 A * 2/1999 Harrison ..... 273/148 R

FOREIGN PATENT DOCUMENTS

| | | |
|---|---|---|
| BE | 904915 | 6/1986 |
| CA | 2170664 | 2/1996 |
| FR | 2482335 | 8/1979 |
| GB | 2203045 | 10/1988 |

* cited by examiner

*Primary Examiner*—Jeanette Chapman
*Assistant Examiner*—Dolores R. Collins
(74) *Attorney, Agent, or Firm*—William R. Bachand; Squire, Sanders & Dempsey, LLP.

(57) ABSTRACT

The present invention is directed to an apparatus for use in playing a word game, in particular a crossword game, and a method of playing such a game using the apparatus. In particular the invention is directed to an apparatus and game that is suitable for play by two or more players which includes means for indicating whether letter(s) nominated for a particular cell of the crossword by a player matches the at least one letter assigned to the cell.

31 Claims, 7 Drawing Sheets

APPARATUS FOR PLAYING A WORD GAME

Figure 1:
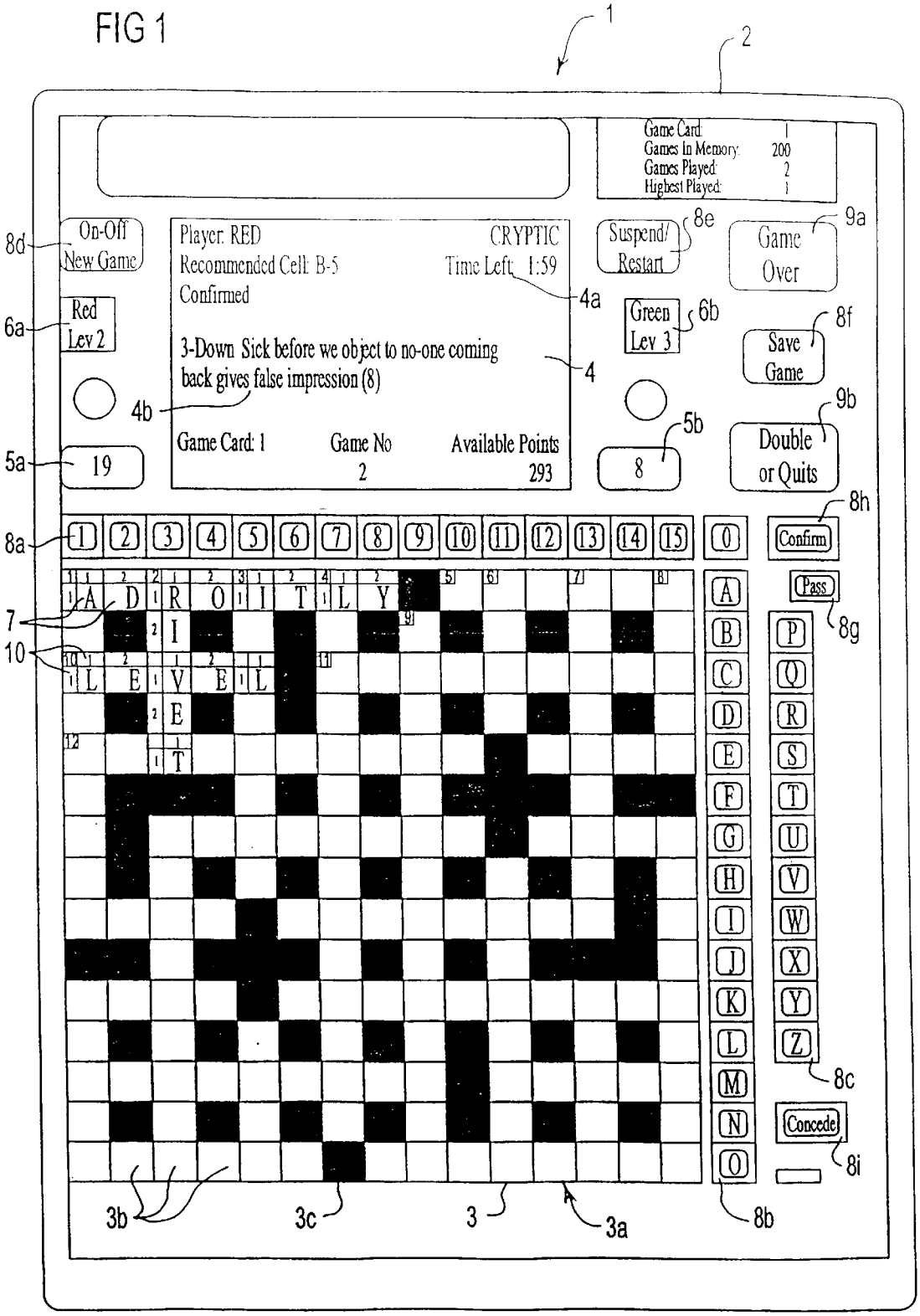

This is a continuation of PCT/AU98/00398 (WO 98/53889) filed on May 29, 1998.

The present invention is directed to an apparatus for use in playing a word game, in particular a crossword game, and a method of playing such a game using the apparatus. In particular the invention is directed to an apparatus and game that is suitable for play by two or more players.

The crossword puzzle is a very popular and well known pastime and typically comprises an arrangement of squares, each square representing the letter of a word or phrase and clues for solving the identity of the words or phrases. However, the solving of crosswords is typically a solitary exercise and crossword puzzles in their current format do not readily lend themselves to competitive play between two or more players. The present invention seeks to overcome this disadvantage of known crossword puzzles.

Accordingly, in one aspect the present invention is directed to an apparatus for playing a word game, said game being suitable for play by two or more players, said apparatus including;

a plurality of cells arranged in one or more series, each cell having at least one letter assigned to it and the assigned letters of each series forming a word or phrase, said plurality of cells having associated therewith one or more clues for determining the identity of each word or phrase; and means for indicating whether a letter nominated for any cell matches the at least one letter assigned to said cell, wherein during play of said game said means is capable of performing this function without simultaneously revealing the letter or letters assigned to one or more other cells for which a letter or letters have not been nominated.

Throughout this specification the term "cell" means a defined area in which a letter can placed. For example where the arrangement of cells is printed on a sheet of paper, each cell may be a blank square surrounded by a printed border and a letter can be written in the square. Alternatively, the arrangement of cells may be displayed on the liquid crystal display of an electronic device and each cell may be a blank area surrounded by an electronically created border. A letter can be electronically displayed in each cell.

The one or more series of cells may be arranged in rows and/or columns. It is further preferred that the series are arranged in intersecting rows and columns to form a typical crossword matrix.

In a preferred embodiment, the indicating means reveals the letter assigned to a cell after a nomination for that cell has been made, thereby indicating whether the letter nominated for the cell is correct or not.

In a preferred embodiment, the apparatus includes means for recording a letter or letters nominated for a cell or cells by different players. Preferably the recording means can record the letters nominated by different players in such a manner that the letters nominated by one player can be distinguished from the letters nominated by another. For example, the apparatus may include different coloured markers for the players to record their nominated letters.

The apparatus can be used in a game played between two or more players. For example, in one method of playing a two player game, the first player attempts to solve a word for a given series of cells. The player selects a cell in the series; and a clue (or clues if the cell is a member of more than one series) for solving the word of the series is given. The player then nominates a letter for the selected cell. The indicating means indicates whether the letter nominated for that cell is correct and if the letter is correct, the player is rewarded. For example, the player may be allotted a certain number of points and/or be permitted another turn. If the nomination for the selected cell is incorrect, the player may suffer a penalty such as loss of his turn to the second player. After each turn the indicating means reveals whether a nomination for a cell was correct or not, thereby providing immediate feedback to the players.

It is possible for two people to play a standard crossword puzzle of the type that appears in a newspaper where solutions for the crossword appear in a separate and identical matrix. For example, each player could take it in turn to write a word (or words) of the crossword until the crossword was completed. The players' answers could then be compared with the solution for the crossword. However, it will be apparent from the description above of the apparatus of this invention, that this apparatus provides numerous advantages over the arrangement appearing in a newspaper which does not include an indicating means that is capable of functioning in the manner as described above. For example, when using the apparatus of this invention, each player's turn can be terminated when a player incorrectly nominates a letter for a cell as the indicating means can provide immediate feedback to the players. Thus the incorrect nomination of a letter for a cell cannot mislead subsequent plays, as it would in the aforementioned game with a standard crossword puzzle of the type that appears in a newspaper.

The apparatus of the present invention may be in a non-electronic format. For example, the plurality or arrangement of cells may appear in printed form on a sheet, for example on a board or on paper. In this embodiment, the letters assigned to each cell are printed in each cell. A cover means is located over each of the cells and is configured so that the cover means located over one cell is removable without disturbing the cover means located over another cell (thus the cover means constitutes the indicating means). In a further preferred embodiment the cover means is a single sheet where a portion of the cover over one cell can be removed without disturbing a portion of the cover over another cell. In a further preferred embodiment the cover is a sheet of material such as paper having an adhesive applied to one surface to permit it to adhere to the printed cells. The cover may be scored to allow one section of the cover to be removed without disturbing an adjacent portion. The adhesive is of an appropriate type to permit this.

To play a crossword game using this apparatus, a player selects a cell of a series and is given a clue (or clues if the cell is a member of more than one series) for that series. The player then nominates a letter for a selected cell and removes the cover located over the cell to reveal whether the letter nominated for the cell matches the letter assigned to the cell.

A letter can be nominated by simply calling it out. Alternatively, it can be recorded by writing it down, each player having a different coloured marker to distinguish between letters nominated by different players. A letter could be directly written on the cover located over a cell. Alternatively, a matching printed arrangement of cells may be provided and each player's nomination can be written on this matching printed arrangement.

In an alternative embodiment, the arrangement of cells appears on a board. The apparatus includes a plurality of square tiles with a letter appearing on one side of each tile and the other side blank. Each tile covers a cell. At the commencement of a game, the letter on each tile matches the assigned letter of the cell it covers. The tiles are placed with their letter side facing away from the players. Clues in written form are provided to the players. Each player has a different coloured marker and can mark a cell with their nominated letter. A tile marked in this way can be turned over independently of other tiles to reveal whether the letter nominated for that cell is correct or incorrect. If incorrect, the answer is given. It can be seen that in this manner, the answer for a single cell can be revealed without revealing the answers to cells that have not been selected. Minor variations of such an embodiment could enable the apparatus to be used in a situation where the players are contestants in a TV game show.

In a variation of the apparatus, a numeric value (or score) is associated with each cell. When playing a game using this apparatus, a player may be awarded the score for each cell correctly nominated by that player. Thus the apparatus may further include means for recording the progressive score of each player. The score recording means may also be capable of displaying the score or this function may be performed by a separate component.

In certain situations it may be desirable for the numeric value associated with cells that have not yet been nominated to be altered. For example, in a two player game, if one player has accumulated more than the sum of his opponent's progressive score and the sum of the values of the cells yet to be nominated, that player would at that stage win the game if the winner is determined by the highest score. In this instance, it may be desirable to allow the values associated with the remaining unselected cells to be increased (for example by doubling) in which case it would be then be possible for the second player to win. Thus in a preferred embodiment the apparatus includes a means for altering the numeric value associated with the one or more cells.

In another variation of the game, each player is required to complete their turn within a certain time (which may be different for each player). Thus the apparatus may include a timing means for measuring the length of time of each player's turn. It may further include signalling means to indicate when a player's turn has expired.

The apparatus may be used to play a game between two or more people with different abilities. In this situation it may be desirable to handicap the stronger player. One way of achieving this is to provide a different set of clues to each player, the clues differing in their degree of difficulty. Thus the weaker player would be provided with easier clues than his more skilled opponent. Accordingly, in a preferred embodiment, the apparatus includes different sets of clues for each arrangement of cells, said clues being graded according to their level of difficulty.

Where clues of different levels of difficulty are provided to the players, it is important that a player not be able to read clues provided to an opponent. Accordingly, in a preferred embodiment, the apparatus includes means to conceal a set of clues from an opposing player. Such means may be a shield or other concealing device that can be placed around a set of written clues for example.

Alternatively each player may receive clues on physically separate means such as cards.

It is also preferred that a player not be permitted to read all the clues for the game at the one time and that the player only be given the clue (or clues if the cell is a member of more than one series) pertaining to that cell or series of cells that the player is attempting to solve. Accordingly, in a preferred embodiment the set of clues are present in a form such that a clue for one series of cells can be provided to a player without simultaneously providing to the player clues for other series whose cells have not been selected. For example in a preferred embodiment, the set of clues are present in written form on paper, board or other sheet material. A covering sheet is placed over the set of clues, the covering sheet having an adhesive applied to one face to adhere it to the written clues. The covering sheet is scored to permit a portion of it to be removed to reveal a clue, without disturbing other sections of the cover sheet and thereby revealing other clues that are concealed.

Alternatively the apparatus may be an electronic device. Accordingly in another aspect the present invention is directed to an electronic apparatus for playing a word game, said game being suitable for play by two or more players, said apparatus including;

data storage means having stored therein:

(i) one or more arrangements of cells, said cells of each arrangement when displayed being positioned in one or more series, each cell having at least one letter assigned to it, the letters of each series forming a word or phrase; and (ii) one or more clues for determining the identity of each word or phrase;

one or more visual display means to permit the one or more arrangements of cells and one or more clues to be displayed;

input means to permit a player to select a displayed cell or cells and nominate a letter for each selected cell;

recording means to record a cell or cells selected by a player and a letter nominated for each selected cell by said player;

means for comparing the letter nominated for each selected cell with the letter assigned to each cell; and means for indicating whether the letter nominated for each selected cell does or does not match the letter assigned to that cell.

Preferably the electronic device has means to associate the letter or letters nominated by each player with said player Again it is preferred that the series of cells of each arrangement when displayed are set out in rows and columns to form a typical crossword matrix.

Various components of the electronic apparatus of the invention may be embodied in software, with other components embodied in hardware such as integrated circuit boards or microchips. Accordingly, the apparatus may take various forms such as a hand held electronic device with an in-built software component. Alternatively, it may be embodied by a desktop, laptop or palm top computer in combination with software components or the combination of an electronic unit connectable to a television screen.

In a preferred embodiment the one or more display devices of the apparatus is a liquid crystal display or a computer or television screen. Preferably the device has two such display devices, one for displaying the arrangement of cells and the other for displaying the clues used to play the game and other information relating to the game.

A preferred input means includes a series of keys for inputting information into the apparatus. For example the keys may include alphabetically marked keys which are used to nominate a letter. Further, these and numerically marked keys may be used to select a cell. Other keys may be present to control different aspects of the crossword game and these shall be discussed in further detail later in this specification when discussing these additional aspects.

In an alternative embodiment the visual display device is a screen that is touch sensitive. In other words, by contacting different parts of the screen, information may be input to the apparatus. In this embodiment, the display means and input means may be integrated into a single component.

The storage means may in one embodiment be an electronic memory of the type well known to a person skilled in the field of computer and electronic technology. Alternatively, the storage means may be a component separate and connectable to the main body of the apparatus. Such a storage means may comprise a compact disc, optical disc, floppy disc, optical mask sensed card, magnetically encoded strip card or other means for storing data. Such cards, discs, etc. are loadable into the apparatus to permit the data stored thereon to be transferred to the memory in the apparatus and the data is then accessed and may be displayed on the display means. Alternatively, a reading mechanism maybe present in the apparatus for directly reading the data from the card, disc etc. to enable the relevant data to be displayed on the display means.

The recording means, associating means and comparison means of the electronic apparatus may be embodied by components of a software program. In the embodiment of a hand held electronic device, this software may be permanently housed in the body of the device itself. Where the apparatus is in part embodied by a personal or laptop or palm top computer or other similar device, this software may be present on a separate disc, card or other storage means to enable the software to be loaded onto the hardware component of the computer or other similar device.

The indicating means may be a visual or aural indicator. For example it may a light or sound generating device such as a light emitting diode or buzzer. Alternatively, the indicating means may be a computer graphic that appears on the display means of the apparatus.

In a preferred embodiment the indicating means reveals the letter assigned to each cell after a letter for that cell has been nominated.

Preferably the indicating means can function in the manner described above without revealing the letters assigned to cells that have not been selected. Thus, where a player's turn comprises the selection of a single cell of a series, the indicating means can reveal whether the nominated letter matches the letter assigned to that cell without also revealing the letters assigned to other unselected cells of the series.

As noted previously, it is preferred to associate numeric values with each cell of the arrangement. Accordingly, the electronic apparatus may have calculating means for calculating the total and/or progressive scores of each player as the game is played. Further, it may include means for displaying these scores. Such score display means could be a computer graphic that appears on the visual display means. Furthermore, the device may include means to permit the value of one or more cells to be altered. This may be by an input key operatively connected to a software component of the apparatus.

As in the non-electronic form of the apparatus, the electronic apparatus may also have a timing means to measure the time each player has to complete a turn. The time of each player's turn or the time remaining to complete a turn may be displayed by a computer graphic on the visual display means.

The storage means of the electronic apparatus may contain different graded levels of clues. In this embodiment the apparatus may include means to select clues of a desired degree of difficulty. This may be an input key operatively connected to a component of the software of the device. Further, where different levels of clues are provided to the players, means may be provided to conceal a clue provided to one player from an opponent. For example, where the clues are displayed on a screen, a shield may be provided around the screen to prevent an opposing player reading a clue. Alternatively, each player may be provided with their own separate visual display on which clues can be displayed, such as detachable liquid crystal displays, or possibly even separate computers connected over a network.

It is further preferred that the electronic apparatus is capable of operating to provide a clue to a player pertaining to the cell or cells the player has selected without simultaneously revealing the clues for other cells that have not been selected.

The electronic apparatus may include other additional features for operation during the play of a game. For example, it may include means to suspend and resume a game in progress, means for saving a game that is partially played in the memory of the apparatus and for recalling a saved game from the memory and means for specifying the number of players in the game. Further, the electronic apparatus may include means for recommending to a player what cell the player should select next. Such means may be a computer graphic operatively connected to a component of the software program of the apparatus. For example the graphic may appear in the cell that is recommended. Alternatively, the graphic may comprise the location reference of the cell. A player may then choose to accept the recommendation and select this cell by operating an input key.

In another embodiment, the one or more arrangements of cells and clues may not be stored in the electronic apparatus but may be generated when the apparatus is activated. Accordingly, the apparatus would not require the storage means as earlier described but has means for creating the one or more arrangements of cells and one or more clues on activation of the electronic apparatus. The apparatus has the one or more visual display means, the input means, the recording means, the associating means, the comparing means and the indicating means. The apparatus may also have one or more of the preferred features as described earlier.

It is further considered that the computer software program of the electronic device as described above is itself new. Accordingly, in another aspect the present invention is directed to a computer data storage medium having software stored therein for use with a computing apparatus having one or more visual display means and input means, said software causing the computing apparatus to display a word game to be played by two or more players and having;

one or more arrangements of cells stored therein for display on said one or more visual display means, said cells when displayed being positioned in one or more series of cells, each cell having one or more letters assigned to it, the letters of each series forming a word or phrase;

one or more clues stored therein for display on said one or more visual display means, said clues for determining the identity of each word or phrase;

recording means to record the cell or cells selected by a player using said input means and the letter nominated for each selected cell by said player using said input means means for comparing the letter or letters nominated for the selected cell or cells with the letter or letters assigned to that cell or those cells; and means for directing said apparatus to indicate whether a letter or letters nominated for the selected cell or cells do or do not match the letter or letters assigned to the cell or cells.

In a preferred embodiment the software has means to associate a letter or letters nominated by a player with said player.

In a preferred embodiment the software permits the apparatus to function in each of the preferred ways as described above in respect of the electronic apparatus. Accordingly the software may have the features to permit this.

In another embodiment the software permits the game to be played interactively by players whose visual display means are in fact different computing devices (eg personal computers) connected over some network (such as a LAN or the World Wide Web) and loaded with the software. Accordingly the software may have features to permit this.

Alternatively, rather than having one or more arrangements of cells and one or more clues stored in the software, there may be contained in the software means for generating the one or more arrangements of cells and one or more clues. This software has the recording means, comparing means and directing means as earlier described. The software may also have one or more of the preferred features of the software as described earlier.

In another aspect the present invention is directed to a method of playing a word game by two or more players, said word game having one or more arrangements of cells as hereinbefore described and one or more clues as hereinbefore described associated therewith, said method including:

each player taking one or more turns having the following steps;

(i) selecting one or more cells; and (ii) nominating a letter for each selected cell; and providing after the completion of each turn and before the commencement of a subsequent turn an indication whether the letter or letters nominated for the cell or cells selected during the previous turn correspond with the letter or letters assigned to said cell or cells.

In a preferred embodiment, the method includes revealing the correct letter or letters assigned to the selected cell or cells after an incorrect nomination has been made. It is further preferred that this is done without also revealing those letters assigned to cells that have not been selected.

The apparatus as described above may be used to carry out this method. The game can be played using the non-electronic, electronic apparatus or computing apparatus having the computer data storage medium as described above. Play of a game using the non-electronic apparatus has been described earlier. When playing the electronic form of the game, each player may use the input means to select one or more of the displayed cells and then use the input means to nominate a letter for each selected cell.

In one preferred method of play, a reward is provided to a player for the correct nomination of a letter or letters for a cell or cells. For example, where points are associated with each cell, this reward may be earning the points associated with those cells correctly nominated. In addition, or alternatively, the reward may be permitting the player to continue to select cells and nominate letters for the cells until the player makes an error. Then the next player may commence their turn.

Further, a penalty may be given for the incorrect nomination of a letter for a cell. This penalty may be deducting points from a player's score or awarding the points to an opponent.

In one embodiment of the method of playing the game of this invention, each player is only permitted to select one cell at a time. Alternatively, the player may be permitted to select all of the cells that form a series at one time.

In one method of play, when a player selects a cell or cells, only the clue or clues pertaining to that cell or those cells is provided to the player. Alternatively, all the clues for the crossword are provided to the players at the one time before the commencement of play of the game.

In another embodiment of this method, the length of each player's turn is limited to a maximum period. For example, a player may be permitted to continue his turn until the expiry of this time, or the incorrect nomination of a letter during the time period.

In one method of play, the winner of the game is determined by the player that has accumulated more than the sum of his opponent's score and the points associated with the as yet unselected cells of the arrangement being played. Alternatively, where points are not associated with cells, the winner may be determined by the player who correctly nominates more cells of the arrangement being played than does his opponent.

The invention shall now be described with reference to the following figures which illustrate preferred embodiments of the invention.

FIG. 1 is a front view of an apparatus of this invention in the form of a hand held electronic game.

Figure 1A:
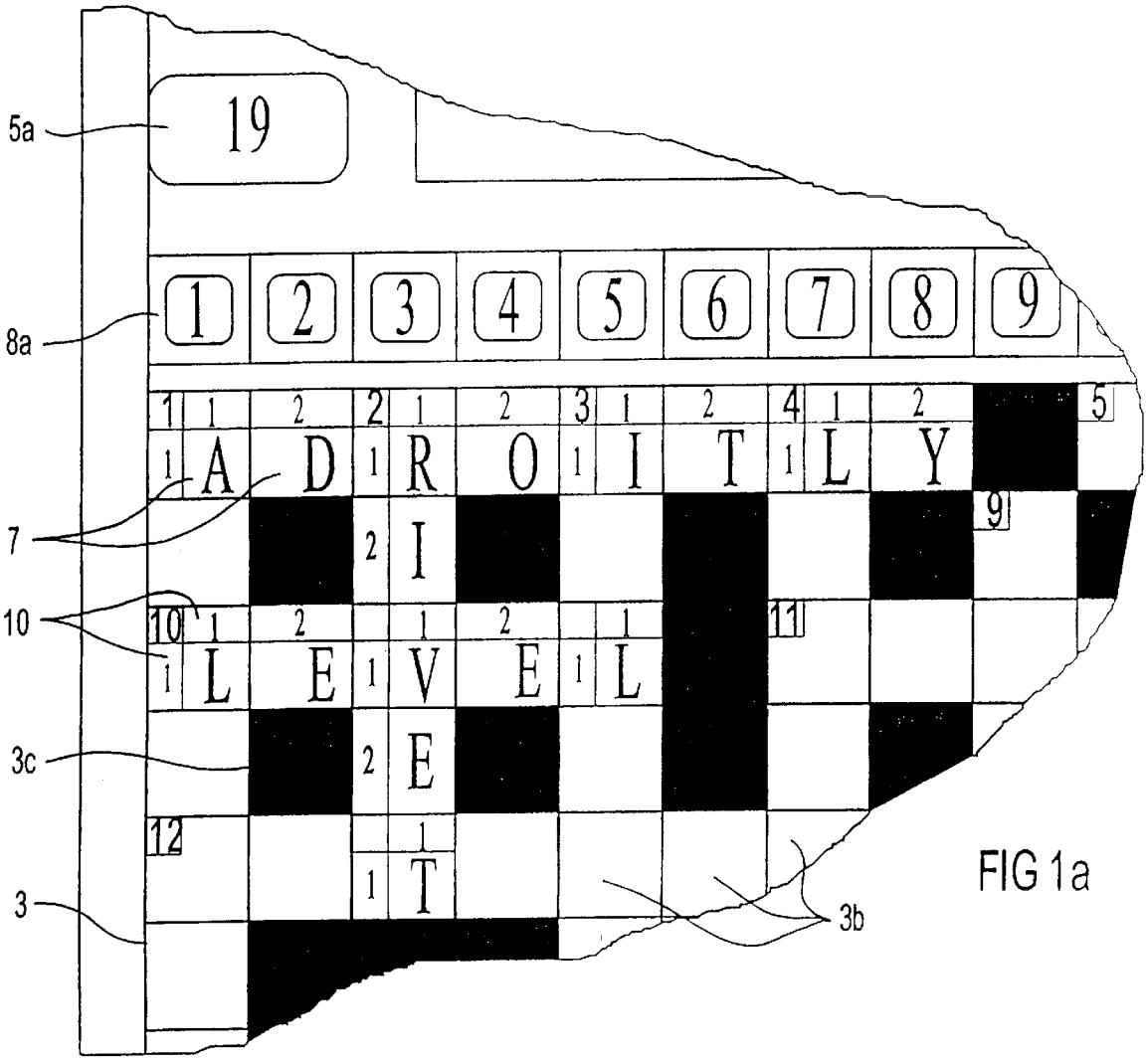

FIG. 1*a* is an enlarged view of the part of the apparatus shown in FIG. 1.

Figure 2:
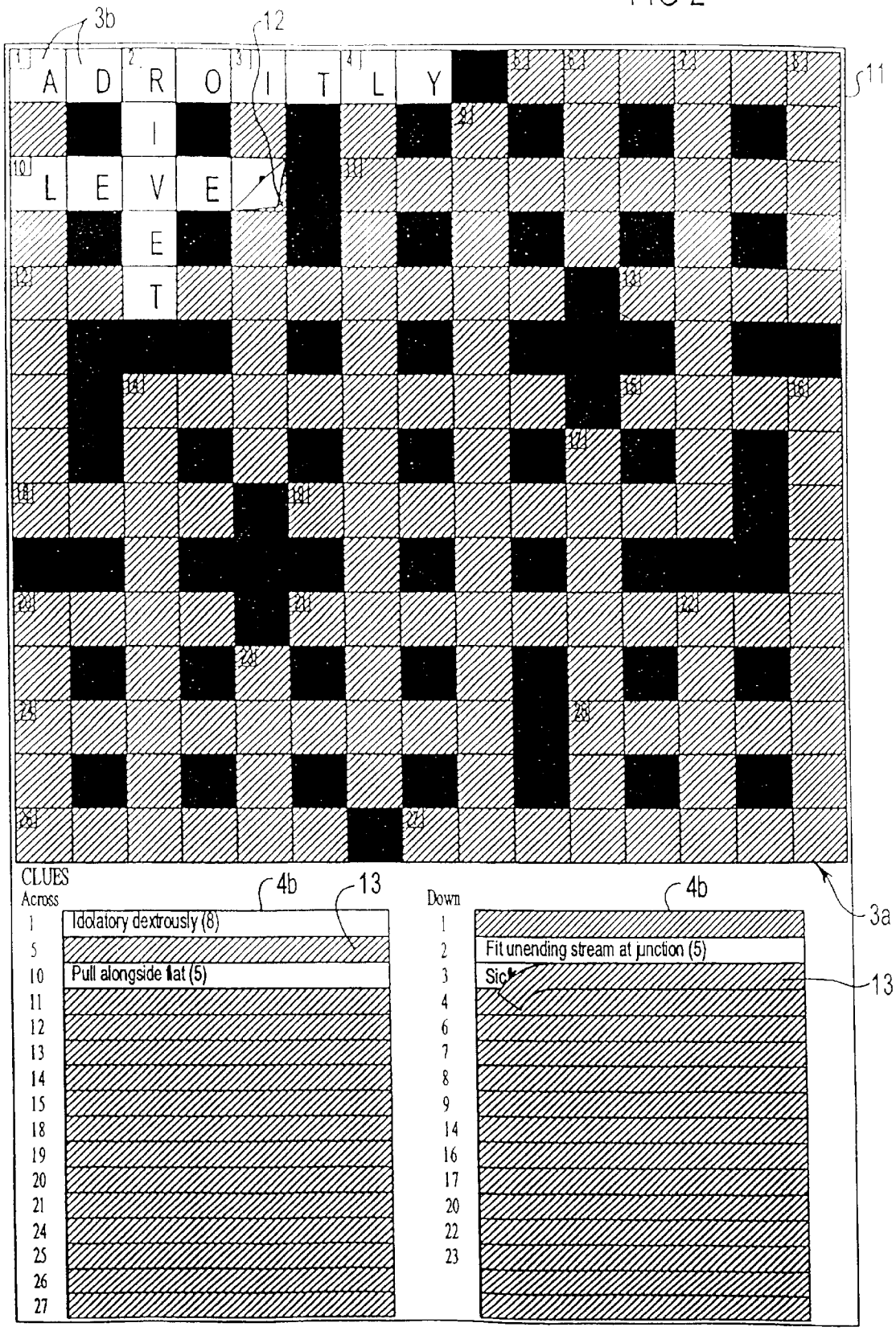

FIG. 2 is a front view of an apparatus of this invention in non-electronic form.

FIGS. 3*a–d* constitute a flow chart diagram showing the logic for a software program of this invention.

Turning to FIG. 1, the device 1 has a body 2 and located on the front of the body is a first liquid crystal display 3. Displayed in the liquid crystal display is a matrix 3*a* of individual cells 3*b* and blacked out or non playable areas 3*c*. Cells 3*a* are arranged in series in rows and columns and a number appears at the commencement of each series to identify the series (for clarity, not all series in the figure have been numbered). There is a second liquid crystal display 4 which displays information pertaining to the game. A timer display 4*a* indicates the time remaining for a player to complete a turn. A clue 4*b* is also displayed. Other information displayed includes which player is currently playing (in the figure the player is identified as "red"), whether a cryptic or standard version of clues is being used, what cell the apparatus recommends the player select next and the number of points associated with the as yet unselected cells of the matrix (termed "available points"). The apparatus has a score indicator which comprises two liquid crystal displays 5*a* and 5*b* showing the progressive scores of the players. Two further liquid crystal displays 6*a* and 6*b* identify the players (in this case designated "red" and "green") and the graded level of clues each player has chosen. The indicating means consists of a graphic device 7 which appears in each cell 3*b* after that cell 3*b* is nominated. In this embodiment the graphic device that is displayed is the letter assigned to the cell 3*b*.

The device 1 has various input keys. Keys 8*a* are numerically marked 1–15. Keys 8*b* are alphabetically marked A–O. Using keys 8*a* and 8*b* a player can identify the position of a cell and thereby select the cell by depressing the correct keys. Keys 8*c* are marked P–Z. By using keys 8*b* and 8*c*, a player can nominate any letter of the alphabet for a selected cell.

Other input keys for use in playing the game are numbered 8*d–*8*i*.

Located on the device 1 is also a game over indicator 9*a* and a "Double or Quits" indicator 9*b*.

Graphically displayed in each cell 3*a* when a letter has been nominated for said cell is a vertical and/or horizontal bar 10 which reveals the numeric value associated with said cell.

Various components of the device 1 are embodied in a software program (not shown). For example the matrix 3*a* and clues 4*b* are stored in electronic format in the software program. The means for recording a cell selected by a player and a letter nominated by a player, the means for associating a letter with a player and the means for comparing a nominated letter with an assigned letter also form part of the software program of the device. The input keys 8*a*–8*i* and first and second visual displays 3 and 4 are operatively connected to the software program.

An example of a method of playing the game using the apparatus shall now be described. In FIG. 1, a game in progress is illustrated. The players of the game are designated "red" and "green". This particular game has clues in cryptic form. As the green player is the more skilled of the two, green has selected a level of clues having a higher degree of difficulty than the level of clues selected by red player. Red commences the game and using input keys 8*a* and 8*b*, Red selects cell identified as 2A. A clue for the identity of the word represented by the series of cells 1A–8A (that is 1-Across) is displayed on display means 4.

Using input keys 8*b*, Red nominates the letter "D" for this cell. The letter assigned to this cell is graphically displayed in the cell. In this case the correct answer is "D" revealing that Red's nomination for the cell was correct. A horizontal bar is also graphically displayed in cell 2A in the colour red. The numeric value associated with cell 2A appears in the bar. The appearance of the horizontal bar in red indicates that the numeric value associated with the cell 2A (2 points) is awarded to the Red player.

As Red has correctly nominated the letter for cell 2A, his turn can continue. Red selects the cell 1A. As cell 1A intersects series 1-Across and 1-Down, the clues for both series of cells appear on display 4. Red nominates the letter A for the cell. The correct answer, which is "A", is graphically displayed in cell 1A. At the same time, a vertical and horizontal bar appears in the cell 1A. A value of 1 point is assigned to cell 1A as it forms part of series 1-Across and 1 point is assigned to cell 1A as it forms part of series 1-Down. As Red has successfully nominated a letter for a cell in the series 1-Across, he is awarded 1 point for cell 1A as part of this series. This is indicated by the appearance of the horizontal bar in cell 1A in the colour red. The vertical bar in this cell is coloured neither red nor green to indicate that the value has not been awarded to either player yet. The value for cell 1A in the series 1-Down will be awarded to the first player who correctly nominates another cell in that series. When that happens the vertical bar in the cell 1A will change colour to match the colour of the player.

Red continues to correctly nominate a letter for each cell in the series 1-Across and is awarded twelve points (2 points for each of the 4 cells that are only part of that series and 1 point for each of the 4 cells that also intersects a vertical series). The score is displayed on score display means 5*a*.

In the game exemplified, Red continues his turn and selects cell 3B. Red receives a clue for the series 2-Down. Red correctly nominates the letter "I" for cell 3B. Red is then awarded three extra points (two for cell 3B and one for cell 3A in the vertical direction). Red then selects the cells 3C and 3D and correctly nominates the letter for each cell. Red selects cell 3E and nominates the letter "R" for the cell. The correct letter "T" appears in the cell. The nominated letter does not match the letter assigned to this cell. The vertical bar appears in the cell 3E in the colour green, indicating that 1 point is awarded to the Green player.

In this method of play, a player's turn terminates if an incorrect letter is nominated for a cell or if the maximum time awarded for taking a turn (in this example two minutes) expires.

The player designated green commences his turn and selects cell 1C. A clue for the word represented by the series of cells 1-Down as well as the clue for the word represented by the series of cells 10-Across appears in the display 4. Green nominates the letter "L" for this cell. The letter assigned to this cell, which is "L", appears in the cell. Vertical and horizontal cross bars appear in cell 1C in a colour other than green or red. This indicates that the points for this cell have not yet been awarded to any player. However as Green is the first player to successfully nominate another letter in the series 1-Down he does pick up the 1 point for the cell 1A whose vertical cross bar changes to green.

Green then selects cell 2C and correctly nominates the letter "E" for the cell. This is indicated by the appearance of the letter "E" in the cell. A horizontal bar appears in this cell in the colour green. Two points are awarded to Green. The horizontal bar for cell 1C also changes to green as another cell in the series 10-Across has been selected. Thus Green is awarded one further point. Green then successfully nominates "E" for cell 4C for which he receives 2 points, but then incorrectly nominates "R" for cell 5C for which Red receives 1 point. It is then Red's turn again and he accepts the recommended cell 5B causing the clue for 3-Down to be displayed. The game situation depicted in FIG. 1 has now been arrived at with Red having accumulated 19 points and Green 8 points.

Play continues in this fashion until either player has accumulated more points than the sum of his opponent's score and the sum of the as yet unselected cells in the matrix, or until the matrix 3*a* is completed.

It should be noted that in this method of play a distinction is made between the numeric value associated with a cell that forms the intersection of a vertical and horizontal series, whereas one point is awarded in each direction. Cells not on an intersection have two points associated with them. This is done because when players select a cell forming the intersection of both a vertical and horizontal series they are shown clues for both directions and it is thereby deemed easier to solve these than those cells that are only part of one series.

A less complex method of play would not make this distinction, thereby awarding one point for each cell correctly nominated. With this somewhat simplified method of play, it would be possible to modify the apparatus to dispense with the horizontal and vertical cross bars, and show which player was awarded the points by displaying the letter assigned to each cell in the appropriate colour. This would be "Red" for correct nominations by Red and incorrect nominations by Green and "Green" for correct nominations by Green and incorrect nominations by Red. Although in this preferred embodiment colour has been used to distinguish one player from another, in another embodiment this might also be done using different shades of grey, different patterns, or by inverse shading (ie black-on-white for one player and white-on-black for the other).

The present invention shall now be described with reference to FIG. 2 which illustrates a non-electronic apparatus for playing the game of this invention. A sheet of paper 11 has printed on it a matrix 3*a* made up of cells 3*b*. The cells 3*b* are arranged in rows and columns. The letter assigned to each cell 3*b* is printed in the cell. A covering sheet 12 is placed over the matrix 3*a*. The cover 12 has an adhesive applied on one side to permit the cover to be adhered to paper 11. The cover 12 has score lines to permit a portion of cover 12 covering each cell 3*b* to be removed without disturbing an adjacent portion of the cover 12. The cover 12 has printed on it the outlines of each cell 3*b* and a number at the commencement of each series to identify the series.

Clues 4*b* for each series of cells 3*b* are provided in written form on sheet 11 below the matrix 3*a*. Over each set of clues 4*b* is placed a cover sheet 13. The covers 13 have an adhesive applied to one side to permit each cover 13 to be adhered to paper 11. Each cover 13 has score lines to permit a portion of cover 13 to be removed without disturbing an adjacent portion of cover 13.

In the method of playing the game using the apparatus illustrated in FIG. 2 all the cells 3*b* and all the clues 4*b* are obscured by covers 12 and 13 respectively at the commencement of the game. A player commences his turn by selecting a cell. A clue for the series of which the selected cell forms a part is then revealed by removing the portion of the cover 13 placed over that clue. The player then nominates a letter for the selected cell. The portion of the cover 12 located over the selected cell is then removed to reveal the letter assigned to the cell and thereby reveal whether the nomination made by the player has been correct or incorrect. When a player makes an incorrect nomination for a selected cell, the player's turn ceases and the opposing player may commence their turn.

It can be seen that in the apparatus of FIG. 2, the letter that is assigned to a cell can be revealed by removing the cover located over that cell without also revealing the letters assigned to other cells that have not been selected. Furthermore, a clue for a cell can be revealed without also revealing the clues pertaining to other cells which have not been selected.

FIGS. 3(*a*)–(*d*) show the logic steps for the software program of this invention. It is preferred that the software be loaded on two computing apparatus connected over a network (eg the World Wide Web) to permit the game as herein described to be played between two players over the network.

Unlike the electronic device of FIGS. 1 and 1*a*, this particular embodiment of the software does not distinguish between reward points in the vertical and horizontal directions. It simply allocates one reward point per cell in the first instance (this may later be altered). Players can decide prior to the commencement of play whether or not an opponent is awarded reward points on the incorrect nomination of a letter by the current player (Letter Error). When loaded on a computing apparatus, the indicating means of the apparatus is the display of the selected cell's assigned letter in the colour associated with the player who received the reward, or in the neutral colour if no reward was received (by incorrect nomination if players elected prior to the game not to award reward points to an opponent for a Letter Error).

Furthermore players can choose prior to commencement of play whether or not to reward players for completing a series (Series Completion Bonus) as well as choosing the number of reward points thereby received. A zero Series Completion Bonus is equivalent to not having one. Players can also choose prior to commencement of play whether or not the opponent is awarded the Series Completion Bonus if a series is completed by the current player's incorrect nomination of the letter assigned to a cell (Series Completion Error). A turn in this embodiment consists of the nomination of a single letter for each singly selected cell.

Although in some situations it may be meaningful to allow a game to be "played out" even when the winner is already determined (for example if winning margin is significant), this particular embodiment of the software does not exhibit this feature. Nor does it exhibit the timed turns feature but it could be easily modified to support these features.

Finally this particular embodiment of the software illustrates the so-called "Double-Or-Quits" rule wherein, provided a predetermined percentage in this case 25% of the arrangement's cells are vacant (neither player having selected them) and "Double-Or-Quits" has not previously been offered and accepted, the leading player will lose his turn the first time he reaches a "no-lose" situation, all available points will be doubled including Letter Scores for all vacant cells and Series Completion Bonuses for all incomplete series, and the opponent will thereby be offered the opportunity to win the game.

FIGS. 3(*a*)–(*d*) illustrate the logic steps of the software and these steps are evident from the figures themselves and do not require explanation. However in FIG. 3*b*, steps titled "Selection Confirmed?—No—Ask Player plyr (current player) for Cell Selection via Input Means of Apparatus" and the steps titled "Ask Player plyr for nominated letter for this cell—Confirmed—Yes/No" illustrate the operation of the recording means.

The associating means is not directly referred to in the logic steps. However association is shown through use of the quantity "plyr" in various steps which changes according to which player is making the nomination. Further the step titled "Set plyr=—plyr+3 (Change Players)" in FIGS. 3*c* and 3*d* illustrates the operation of the software to change from one player to another.

Figure 3A:
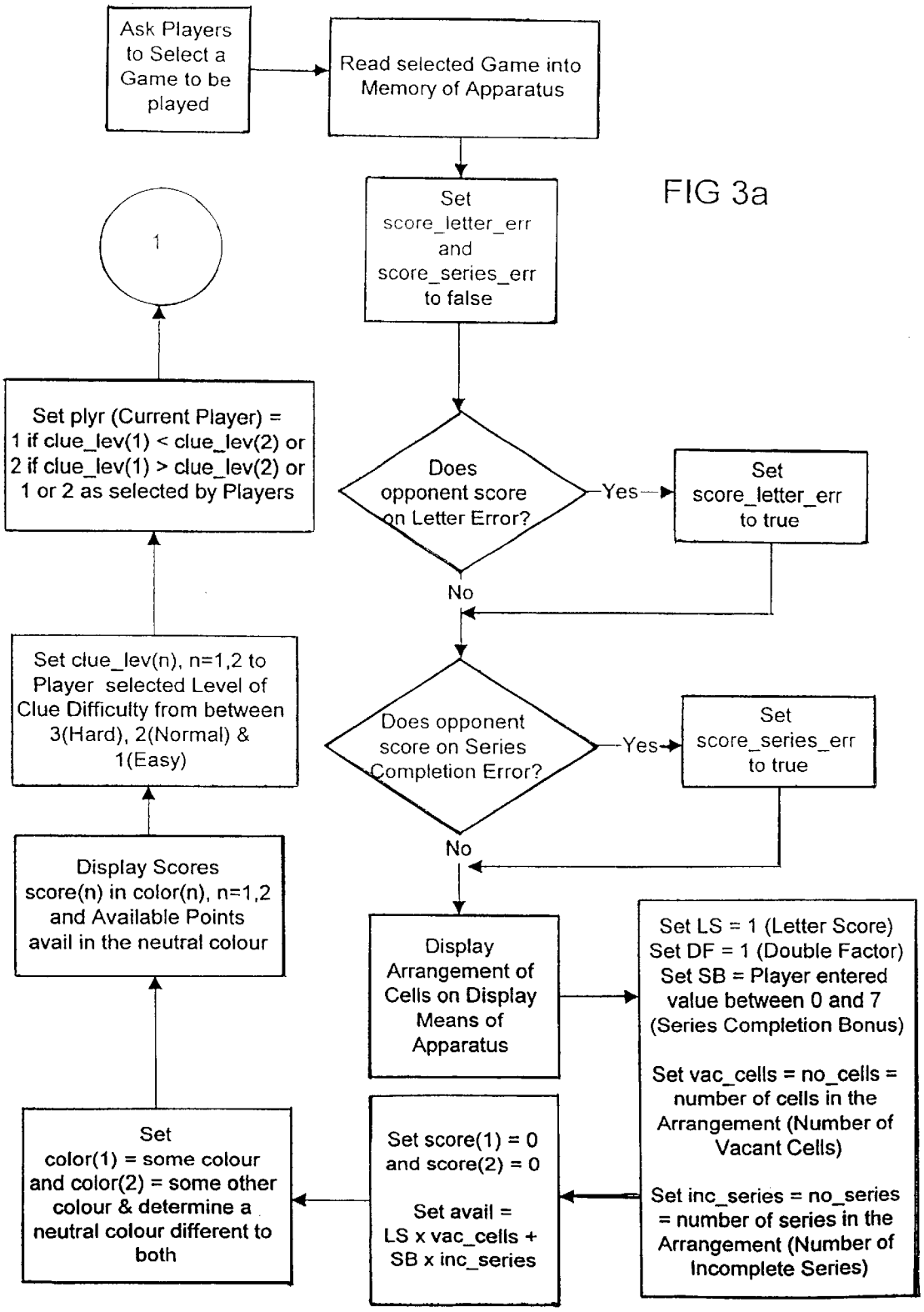
Figure 3B:
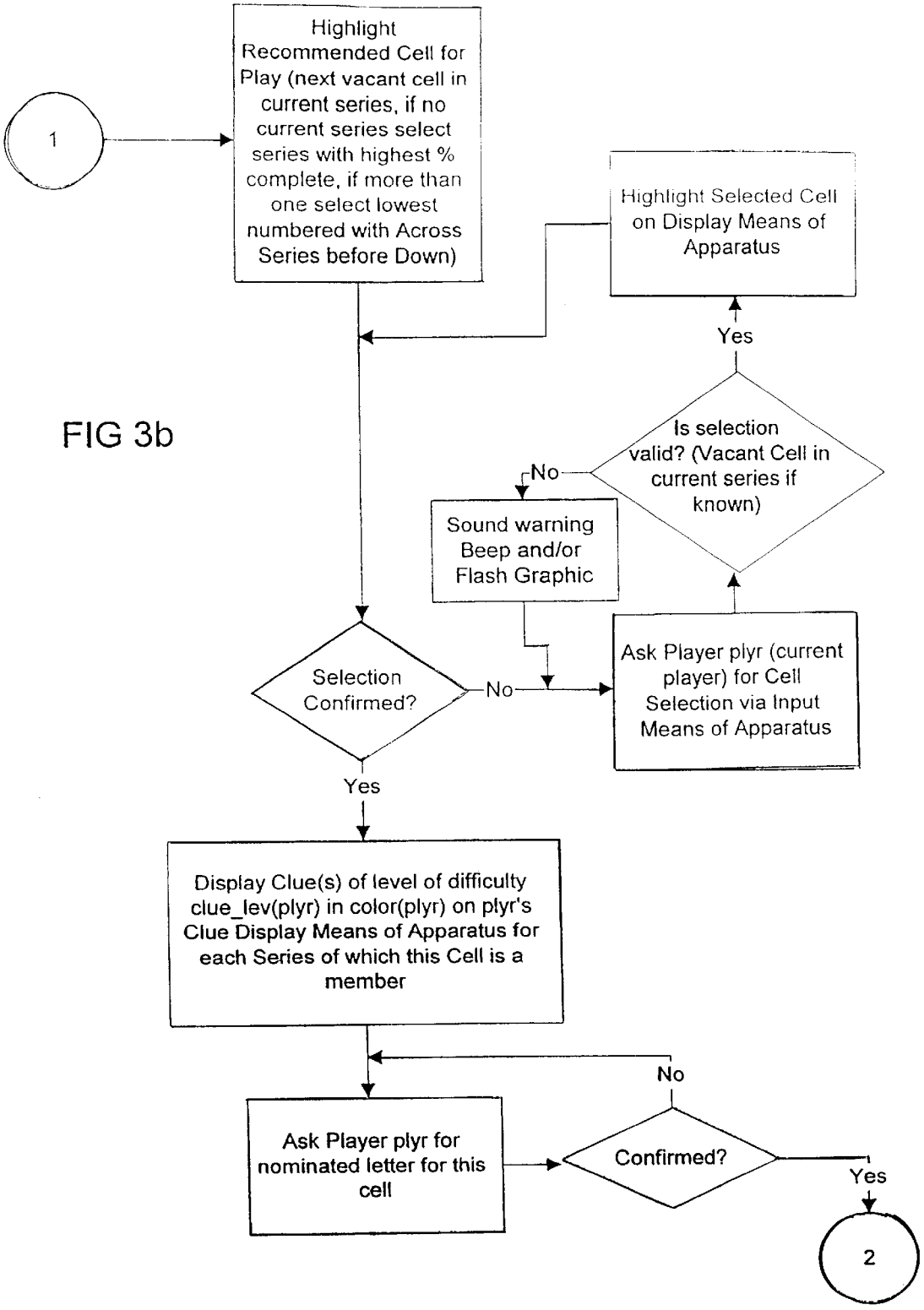
Figure 3C:
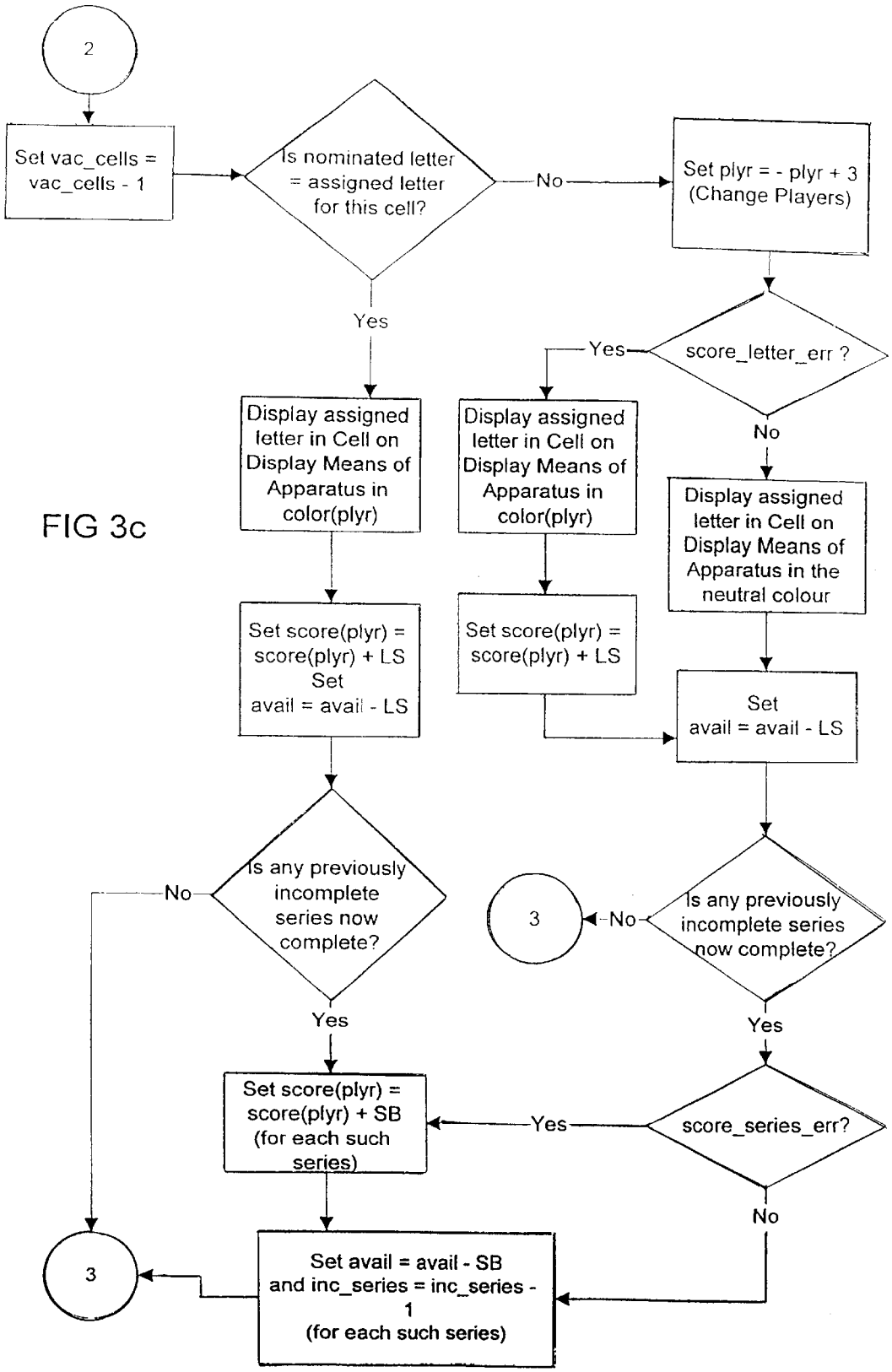
Figure 3D:
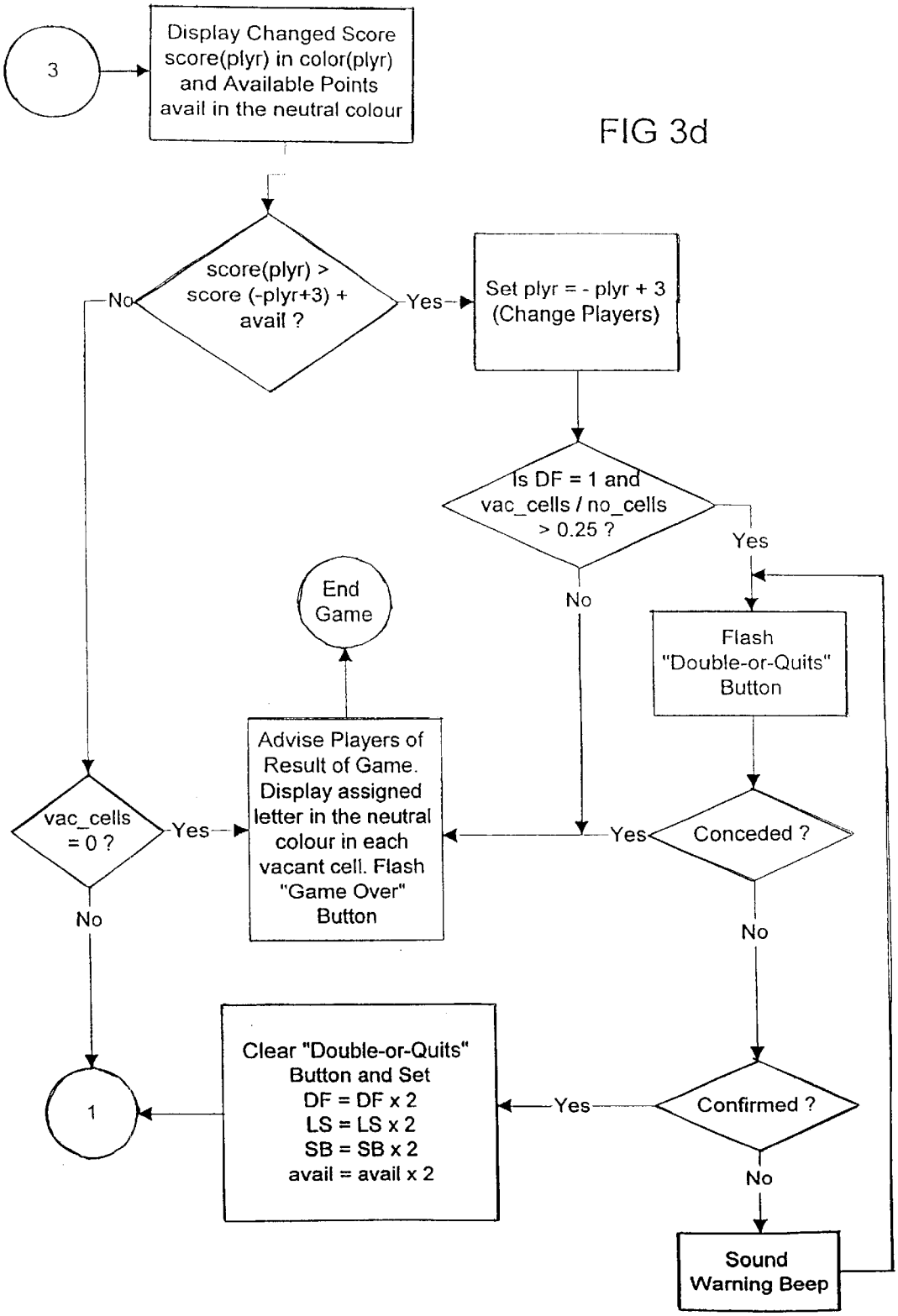

The step "Is nominated letter=assigned letter for this cell?—Yes/No" in FIG. 3*c* illustrates the operation of the comparing means. The steps "Display assigned letter in Cell on Display Means of Apparatus in color (plyr)" and "Display assigned letter in Cell on Display Means of Apparatus in the neutral colour" in FIG. 3*c* illustrate the operation of the directing means.

There are numerous variations on the method of playing the game and the apparatus used in the method of play. These variations include;

(i) During the course of playing a game, if a player has accumulated more than the sum of his opponent's score and the sum of the as yet unselected cells in the arrangement, players may be offered the opportunity to increase the value of points assigned to cells that have not been selected so that the trailing player may have the opportunity to win the game. For example, this may be designated the "Double or Quits" option. In respect of the device shown in FIG. 1, when this stage in the game is reached, the "Double or Quits" indicator 9*b* is lit to indicate that the option is available. The trailing player may then elect to double the value of unselected cells of the matrix being played by pressing input means 8*h* marked "confirm". Alternatively the trailing player may elect to terminate the game at this stage by pressing input means "8*i*" marked "concede".

(ii) A player may elect to pass all or part of his turn. For example, after selecting a cell or series of cells, a player may pass their turn to an opposing player rather than attempt to nominate a letter or letters for the selected cell or cells. When a turn is passed in this way, the assigned letter for any selected cell is not revealed.

(iii) The points associated with a series are only awarded to the player who successfully completes the series (or in the event that a series is completed by an incorrect nomination, the points may be awarded to an opponent).

(iv) Each player is permitted to select any cell during his turn. Alternatively, where one or more of the cells of a series have already been selected (ie. the series is in part completed) a player is required to select another cell of that series for their turn until that series is complete at which point he may select any cell.

(v) A player's turn may terminate when the player has nominated a letter that completes a series of cells.

(vi) Different numeric values are associated with different cells. For example bonus points may be awarded to particular cells or for the completion of particular words or phrases. Alternatively bonus points may be awarded for the completion of each series.

(vii) Where an incorrect nomination is made for a selected cell, the correct letter for the cell is not displayed.

(viii) Where each player's turn is limited to a time period and a player fails to nominate a letter for the selected cell within the allotted time, the player is penalised. For example, the value assigned to the selected cell is deducted from the player's score. Furthermore, or alternatively, the letter assigned to the cell is revealed which may assist an opposing player.

It will be appreciated from the forgoing that the present invention provides an apparatus for playing a word game by two or more players and a method of playing such a word game by two or more players.

It should be understood that various modifications and variations may be made to the apparatus and method as hereinbefore described without departing from the spirit and ambit of the invention.

What is claimed is:

1. An apparatus for playing a word game, said game being suitable for play by two or more players, said apparatus including:

a plurality of cells arranged in one or more series, each cell having at least one letter assigned to it and the assigned letters of each series forming a word or phrase, said plurality of cells having associated therewith one or more clues for determining the identity of each word or phrase;

recording means for recording each letter nominated for said cells by said players in a manner so that each letter nominated by one player can be distinguished from each letter nominated by another player; and indicating means for revealing the letter or letters assigned to each cell, wherein during play of said game each player takes turns in selecting one or more cells and said indicating means is capable of revealing after each turn the letter or letters assigned to said selected cell or cells without simultaneously revealing the letter or letters assigned to cells that have not been selected.

2. The apparatus according to claim 1 wherein the indicating means is capable of revealing the letter or letters assigned to said selected cell or cells, whether a letter has or has not been nominated for said selected cell or cells.

3. The apparatus according to claim 2 wherein the apparatus is in non-electronic form.

4. The apparatus according to claim 3 wherein the plurality of cells is printed on a sheet with each letter assigned to said cells printed on the sheet in each cell, and the indicating means consists of a cover means placed over each cell, the cover means over one cell being removable without disturbing the cover means located over an adjacent cell.

5. The apparatus according to claim 4 wherein the cover means consists of a single sheet, wherein a portion of the sheet located over each cell is removable from the sheet to reveal the cell obscured by the portion without disturbing an adjacent portion of the sheet.

6. The apparatus according to claim 3 wherein the recording means includes two or more different coloured markers.

7. The apparatus according to claim 3 including a timing means.

8. The apparatus according to claim 3 wherein a numerical value is associated with each cell.

9. The apparatus according to claim 3 having two or more clues to determine the identity of each word or phrase, each of the clues having a different degree of difficulty.

10. An electronic apparatus for playing a word game, said game being suitable for play by two or more players, said apparatus including;

data storage means having stored therein:

(i) one or more arrangements of cells, said cells of each arrangement when displayed being positioned in one or more series, each cell having at least one letter assigned to it, the letters of each series forming a word or phrase; and (ii) one or more clues for determining the identity of each word or phrase;

one or more visual display means to permit the one or more arrangements of cells and one or more clues to be displayed;

input means to permit each player to select one or more displayed cells and nominate a letter for each selected cell;

recording means to record each cell or cells selected by each player and the letter nominated for each selected cell by said player;

associating means to associate the letter or letters nominated by each player with said player;

comparing means to compare the letter nominated for each selected cell with the letter assigned to each cell; and indicating means to reveal the letter or letters assigned to each cell wherein during play of said game each player takes turns in selecting one or more cells and said apparatus is capable of revealing after each turn the letter or letters assigned to said selected cell or cells without simultaneously revealing the letter or letters assigned to cells that have not been selected.

11. The apparatus according to claim 10 wherein said apparatus is capable of revealing the letter or letters assigned to said selected cell or cells whether a letter has or has not been nominated for said selected cell or cells.

12. The apparatus according to claim 11 wherein the apparatus is a hand held device.

13. The apparatus according to claim 11 wherein the device has one visual display means to display the one or more arrangements of cells and a separate visual display means to display the clues associated with each arrangement of cells.

14. The apparatus according to claim 11 wherein the indicating means consists of an electronically generated graphic on the one or more visual display means.

15. The apparatus according to claim 11 wherein a numeric value is associated with each cell.

16. The apparatus according to claim 15 wherein the numeric value consists of an electronically generated graphic.

17. The apparatus according to claim 11 including timing means to measure the length of each player's turn.

18. The apparatus according to claim 11 having two or more clues to determine the identity of each word or phrase, each of the clues having a different degree of difficulty.

19. A method of playing a word game by two or more players using the apparatus of claims 1 or 10, said method including:

each player taking one or more turns having the following steps;

(i) selecting one or more cells; and (ii) nominating a letter for each selected cell; or (iii) foregoing nominating a letter for each selected cell revealing after the completion of each turn and before the commencement of a subsequent turn the letter or letters assigned to each cell or cells selected during the previous turn.

20. The method according to claim 19 wherein a reward is given to the player whose nominated letter for each selected cell or cells corresponds to the letter assigned to that cell or cells.

21. The method according to claim 20 wherein the reward includes an additional turn.

22. The method according to claim 21 wherein a numeric value is associated with each cell and the reward further includes obtaining the numeric value.

23. The method according to claim 20 wherein each turn cannot exceed a set period of time, said period of time being the same or different for each player.

24. The method according to claim 20 wherein during each turn a player is only permitted to select one cell.

25. The method according to claim 20 wherein during each turn a player is permitted to select more than one cell.

26. A computer data storage medium having software stored therein for use with a computing apparatus having one or more visual display means and input means, said software enabling the computing apparatus to display a word game to be played by two or more players and having;

one or more arrangements of cells stored therein for display on said one or more visual display means, said cells when displayed being positioned in one or more series of cells, each cell having one or more letters assigned to it, the letters of each series forming a word or phrase;

one or more clues stored therein for display on said one or more visual display means, said clues for determining the identity of each word or phrase;

recording means to record the cell or cells selected by each player and the letter nominated for each selected cell by each player using said input means;

associating means to associate each letter or letters nominated by each player with said player;

comparing means to compare the letter or letters nominated for the selected cell or cells with the letter or letters assigned to that cell or those cells; and means for directing said apparatus to reveal the letter or letters assigned to said selected cell or cells;

wherein during play of said game each player takes turns in selecting one or more cells and said software can direct said apparatus to reveal after each turn the letter or letters assigned to said selected cell or cells without simultaneously revealing the letter or letters assigned to cells that have not been selected.

27. The computer data storage medium according to claim 26 wherein said software can direct the apparatus to reveal the letter or letters assigned to selected cell or cells, whether a letter has or has not been nominated for said selected cell or cells.

28. The apparatus according to claim 10 wherein the one or more visual display means comprises two or more visual display means which are different computing devices connected over a network.

29. The apparatus according to claim 11 wherein the one or more visual display means comprises two or more visual display means which are different computing devices connected over a network.

30. The computer data storage medium according to claim 26 wherein said software enables said wordgame to be played using two or more separate computing apparatus connected over a network.

31. The computer data storage medium according to claim 27 wherein said software enables said wordgame to be played using two or more separate computing apparatus connected over a network.

* * * * *